US006336247B1

(12) United States Patent
Schnoor

(10) Patent No.: US 6,336,247 B1
(45) Date of Patent: Jan. 8, 2002

(54) SCREEN DOOR HANGER ASSEMBLY

(76) Inventor: Frank Schnoor, 3310 SW. Willamette, Corvallis, OR (US) 97333

( * ) Notice: Subject to any disclaimer, the term of this patent is extended or adjusted under 35 U.S.C. 154(b) by 0 days.

(21) Appl. No.: 09/566,667

(22) Filed: May 8, 2000

(51) Int. Cl.[7] ..... E05D 15/06

(52) U.S. Cl. ..... 16/87.6 R; 16/91; 16/94 R; 16/105; 16/106; 49/409; 49/425; 160/196.1; 160/208; 160/214

(58) Field of Search ..... 16/87.4 R, 87.6 R, 16/90, 91, 94 R, 95 R, 96 R, 97, 99, 105, 106; 49/409, 411, 412, 425, 426, 427; 160/196.1, 201, 208, 214

(56) References Cited

U.S. PATENT DOCUMENTS

| | | | | | |
|---|---|---|---|---|---|
| 3,020,582 | A | | 2/1962 | Cox | |
| 3,047,946 | A | | 8/1962 | Lins | |
| 3,057,005 | A | | 10/1962 | Dishaw | |
| 3,239,891 | A | | 3/1966 | Gardner | |
| 3,311,942 | A | | 4/1967 | Edeus | |
| 3,555,612 | A | | 1/1971 | Procton | |
| 3,643,529 | A | * | 2/1972 | Bright | 16/96 |
| 3,698,036 | A | * | 10/1972 | Goodman | 16/100 |
| 3,729,868 | A | * | 5/1973 | Burum | 49/420 |
| 3,854,165 | A | * | 12/1974 | Haley | 16/96 R |
| 4,104,829 | A | * | 8/1978 | Agcaoili | 49/409 |
| 4,112,622 | A | * | 9/1978 | Stewart | 49/421 |
| 4,227,355 | A | | 10/1980 | Wendt | |
| 4,288,887 | A | * | 9/1981 | Johnson et al. | 16/105 |
| 4,458,449 | A | * | 7/1984 | Breuer | 49/411 |
| 4,572,268 | A | * | 2/1986 | Wentzel | 160/201 |
| 4,722,150 | A | * | 2/1988 | Jacobs et al. | 49/425 |
| 4,742,645 | A | | 5/1988 | Johnston | |
| 4,887,394 | A | | 12/1989 | Marlowe | |
| 4,899,493 | A | * | 2/1990 | Baumgarten | 49/425 |
| 4,943,110 | A | * | 7/1990 | Pastva | 296/181 |
| 5,115,596 | A | * | 5/1992 | Fevold et al. | 49/411 |
| 5,123,128 | A | * | 6/1992 | Hines | 4/557 |
| 5,203,116 | A | * | 4/1993 | Chen | 49/404 |
| 5,287,655 | A | * | 2/1994 | Harvey | 49/425 |
| 5,657,581 | A | * | 8/1997 | Husting | 49/409 |
| 5,970,578 | A | * | 10/1999 | Mensching et al. | 16/94 R |
| 6,115,968 | A | * | 9/2000 | Sarlanis | 49/409 |
| 6,141,827 | A | * | 11/2000 | Wu | 16/91 |

FOREIGN PATENT DOCUMENTS

DE 004239714 A1 * 6/1994

* cited by examiner

*Primary Examiner*—Anthony Knight
*Assistant Examiner*—Alison K. Pickard
(74) *Attorney, Agent, or Firm*—Karen S. Hock

(57) ABSTRACT

A hanger assembly for a sliding screen door comprises a horizontally mounted track that fits within a standard door header and roller assembly, preferably one roller assembly per side of the screen door. Each roller assembly comprises at least a roller, and preferably two per roller assembly, and a holder that connects the roller(s) to the screen door. The holder includes a connecting bar portion that attaches to the roller(s) and a generally U shaped bracket portion that extends downwardly from the connecting bar portion, whereby the screen door is positioned and held snugly within the U shaped portion. A side of the bracket U shaped portion includes a slot for vertically and/or horizontally adjusting the screen by positioning of attachment means through the slot such as a screw.

3 Claims, 3 Drawing Sheets

SCREEN DOOR HANGER ASSEMBLY

BACKGROUND

1. Field of Invention

This invention relates generally to a hanger assembly for a sliding screen door and more particularly to a hanger assembly for a sliding screen door that allows for vertical and horizontal adjustment of the screen door relative to the frame for the screen door and equal hanging support for the screen door, smooth and continuous operation of the screen door, and the conversion or replacement of an existing screen door from sliding along a bottom track to a screen door that slides along a horizontally top mounted track.

2. Description of Prior Art

Sliding screen doors of the type used for the common sliding patio door have a myriad of problems associated with them due to the typical design whereby the screen door slides on rollers in a bottom track. These problems include difficult operation such as dragging and skipping, often, due to dirt and debris clogging the bottom track and the fact that the mechanism is often exposed to the weather due to its position, the tendency to "pop off" the bottom track, and the inability of the screen to be adjusted to fit an uneven frame. As such, many sliding screen doors are either in disrepair, from acts such as pushing too hard on the door in order to move it, are removed due to the problems and not replaced as the same problems will occur again, and/or are not used.

While there are a number of prior art patents that show hanger assemblies for adjustably supporting doors for sliding movement along a horizontally disposed track, not one shows or suggests an assembly for use with a screen door. The prior art hanger assemblies are shown being used or suggest use only with interior sliding pocket doors, shower doors, closet doors and sound absorption panels. In addition, the prior art does not show a hanger assembly that allows for simple, economical and complete adjustability i.e. vertical and horizontal adjustability of any type of door in combination with the hanger assembly providing equal hanging support on both sides of a door in order to maintain smooth and continuous sliding movement of the door.

For example, U.S. Pat. No. 3,057,005 to Dishaw discloses a sliding door hanger that allows for vertical adjustment only via a specially manufactured threaded bolt.

U.S. Pat. No. 3,239,891 to Gardner discloses a panel structure with a hanger that allows for vertical adjustment only via an inclined slot at its upper end.

U.S. Pat. No. 3,311,942 to Edeus discloses a hanger assembly for sliding doors that allows for vertical adjustment only through the use of a circular hand wheel.

U.S. Pat. No. 3,555,612 to Procton discloses a hanger assembly that utilizes parallel angularly displaced slots for permitting horizontal and vertical positioning of a door.

OBJECTS AND ADVANTAGES

Accordingly, several objects of the present invention are to provide:

a. continuous, smooth and easy operation of a sliding screen door, with reduction in dragging and skipping;

b. a design whereby the operating mechanism is protected from the weather;

c. a simply way to convert or to replace existing sliding screen doors to top rolling sliding screen doors whereby the bottom existing rollers operate as guides only;

d. for simple installation and conversion or replacement of screen doors due to the ability to adjust the top mounting assembly to fit uneven frames;

e. for a device that adapts to industry standard replacement screens, custom screens, or existing screens; and f. to provide for a screen that stays in the roller track.

These and further objects will be apparent from the following description and drawings of the preferred embodiments thereof.

BRIEF SUMMARY OF THE INVENTION

The invention is the use of a top mounting hanger assembly with sliding screen doors that allows for both vertical and horizontal adjustability of the screen door while equally supporting the screen door on both sides of the door. The hanger assembly generally comprises a track horizontally mounted within a door frame and a roller assembly, the roller assembly including a roller for horizontal movement along the track and a holder, said holder including a connector bar attached to the roller at one end and a bracket shaped to fit snugly around a screen door. The bracket also includes a slot for adjustability of the screen door within the bracket. Preferably, the track is an integral molded extrusion that includes a c shaped area with lips that retain the roller assembly roller within the track, and upwardly extending flanges and a downwardly extending c shaped area that together interlock and allow two track pieces to fit together thereby reducing bulkiness in shipping. The track preferably also includes a horizontally extending "bug strip" that acts to prevent weathering of the hanger assembly. Preferably, two roller assemblies are utilized per screen door, one attached at each end of the screen door, and include two rollers per roller assembly. The roller assembly holder is also an integrally molded extrusion and the bracket portion is in the shape of a U, the U shaped portion including the slot, which is preferably either vertically disposed for vertical adjustment of the screen door, or angularly disposed for vertical and horizontal adjustment of the screen door.

DETAILED DESCRIPTION

Figure 1:
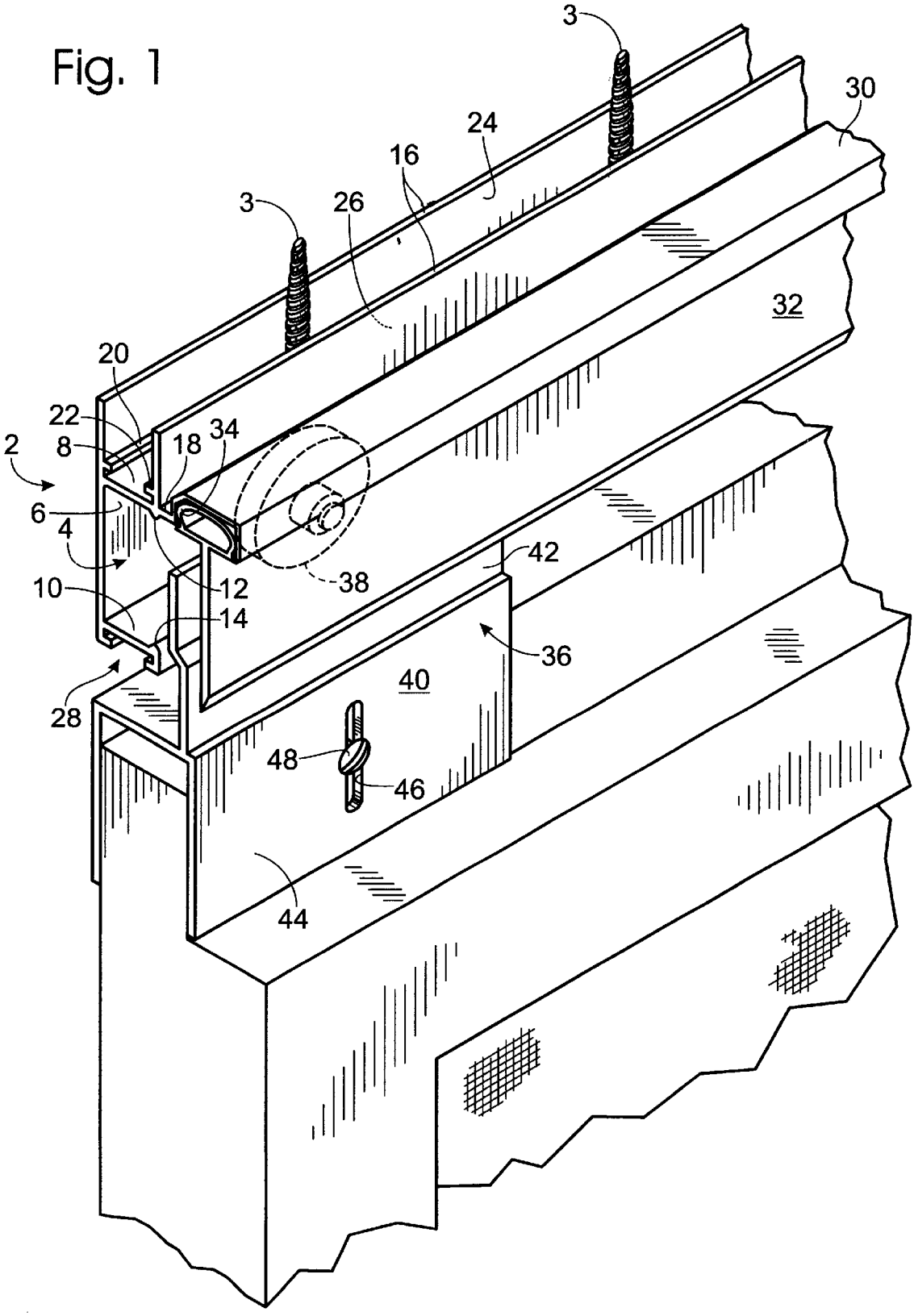
FIG. 1 is a partial perspective view of the preferred embodiment of the screen door hanger assembly and a screen door.
Figure 2:
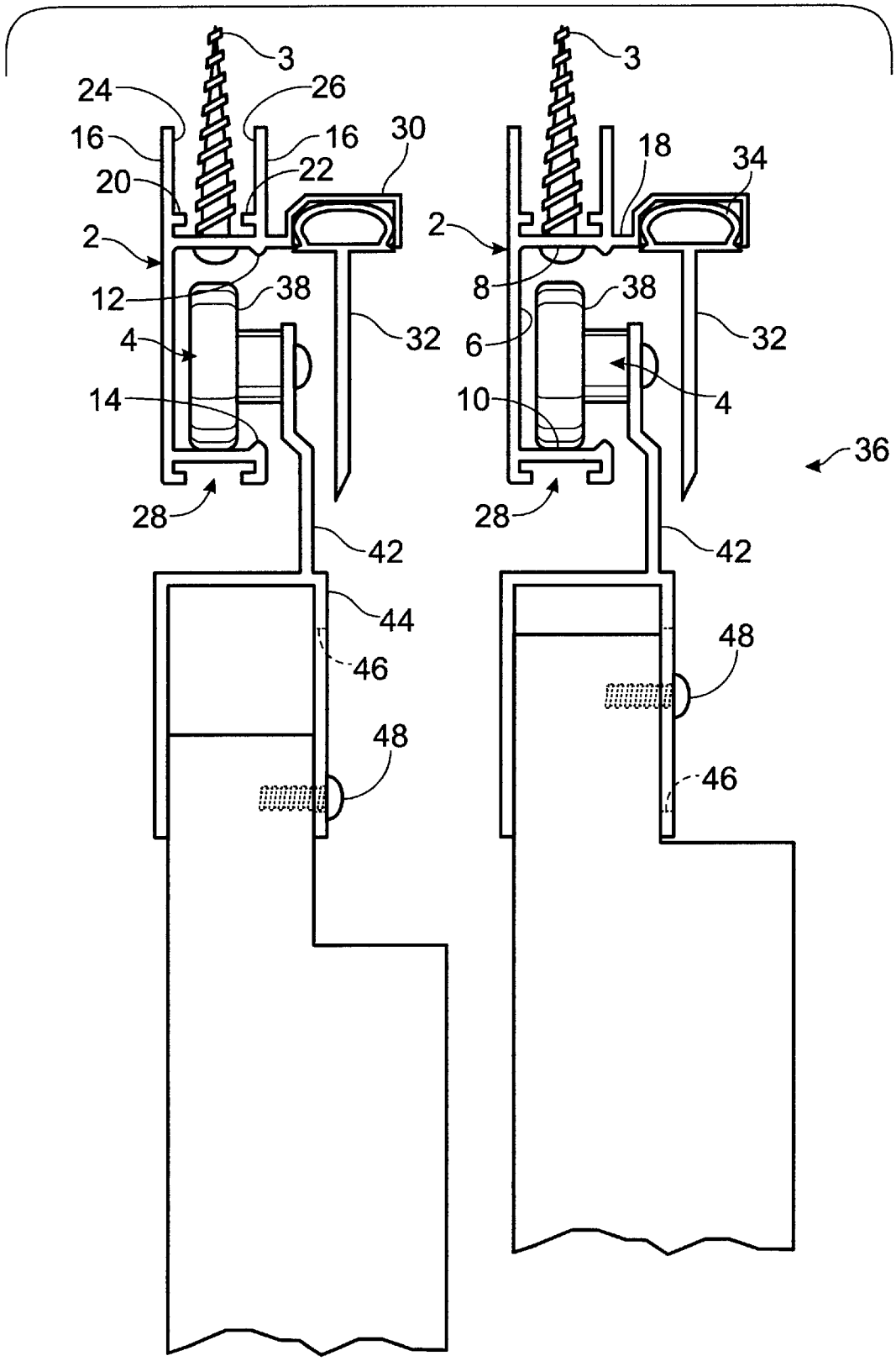
FIG. 2 shows two side views of the preferred embodiment of the screen door hanger assembly of FIG. 1 showing the vertical adjustment of the screen door.
Figure 3:
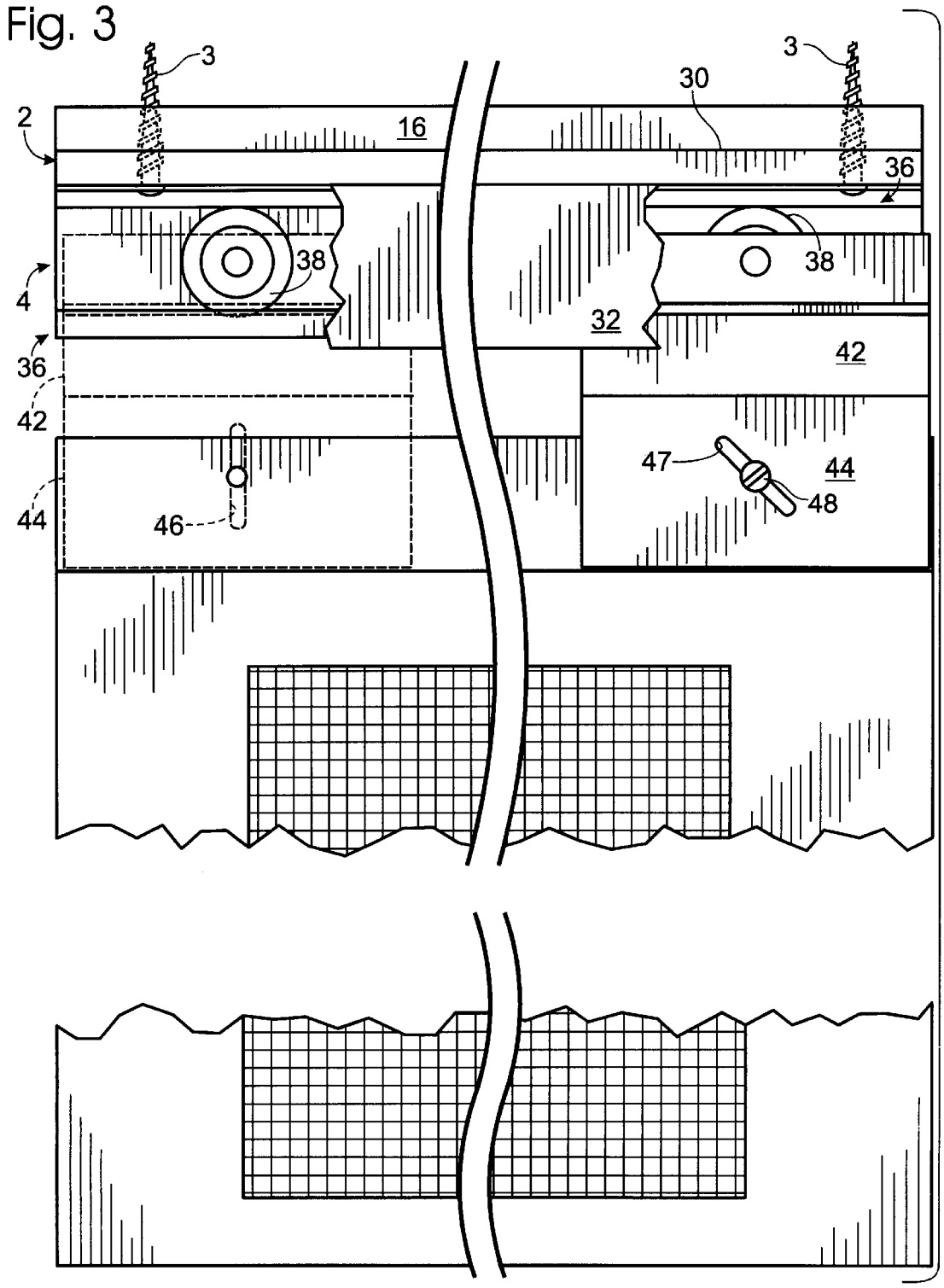
FIG. 3 is a front view cut away of the preferred embodiment if FIGS. 1 and 2 of the screen door hanger assembly and a screen door.

FIGS. 1–3 show the preferred embodiment of the hanger assembly. The hanger assembly comprises an integrally extruded track 2 which is horizontally mounted and secured to a header of a door, preferably with screws 3. The extruded track 2 includes a roller guide area 4 in a c shape with square corners including a back 6, a top 8 and bottom 10, the back 6 in a right angle relationship to the top 8 and bottom 10. The top 8 includes a downwardly projecting lip 12 and the bottom 10 includes an upwardly projecting lip 14, each lip 12 and 14 extending along the length of the track 2 opposite the back 6. The track 2 further includes two identical flanges 16 parallel to each other that extend vertically from the outer edges 18 of the top 8 and are in perpendicular relationship to the top 8. Each flange 16 further includes a rib 20 and 22 extending along each inner wall 24 and 26 of each flange 16 for the length of the track 2. The bottom 10 includes a downwardly extending c 28, also with square comers in a right angle relationship with the bottom 10. The flanges 16 and the downwardly extending c 28 are shaped in the manner described to allow for the interlocking of two pieces of track 2 for shipping in an economical manner. The top 8 outer edge further includes an extension 30 extending along the track 2, generally shaped also in a downwardly facing c, for the retention of a bug strip 32 to prevent weathering of the hanger assembly. The bug strip 32 is preferably fashioned of a vinyl material including a thickened top edge 34, the edge shaped and sized to fit snugly in the extension 30.

While this type of track is shown, the track can be of any configuration or material suitable for the movement of rollers along the track for a screen door.

The hanger assembly further comprises a roller assembly 36 for connection of a roller 38 or rollers to a screen door. Preferably the roller assembly 36 includes at least a roller 38 for horizontal movement along the track 2, and an integrally extruded holder 40 for connection of the roller 38 to the screen door. The holder 40 includes a connecting bar portion 42 attached to the roller 38 and a bracket 44 portion for adjustably holding a screen door, the bracket portion 44 shaped generally as a U extending downwardly from the connecting bar portion 42, one side of the U including a slot 46. The slot may be vertically disposed for vertical adjustment or angularly disposed for horizontal and vertical adjustment of the screen door. The screen door fits snugly into the U shape of the bracket portion 44 and can be adjusted up and down by the positioning of a screw 48 or other connecting or attaching means in the slot 44. Preferably, the holder 40 is 2" wide, and there are two per screen door, one toward each end of the screen door, and preferably there are two rollers 38 per roller assembly 36.

The bracket can include other variations in shape such as a cross section c.

FIG. 2 shows the adjustment of the screen within the bracket portion 44 of the holder 40 by movement of the screw 48 within the slot 46.

What is claimed is:

1. A horizontal track for securing to a header of a door frame, said track including a roller guide area in a c shape with square corners including a back, a top and bottom, said back in a right angle relationship to said top and bottom, said top including a downwardly projecting lip and said bottom including an upwardly projecting lip, each lip extending along the length of the track opposite said back, two identical flanges parallel to each other that extend vertically from the outer edges of the top in perpendicular relationship to said top and each flange including a rib extending along each inner wall of each flange for the length of the track, said bottom including a downwardly extending c, also with square comers in a right angle relationship with said bottom, and said top outer edge further including an extension extending along the track, generally shaped also in a downwardly facing with c, for the retention of a bug strip to prevent weathering; and a roller assembly for connection of said roller to the screen door, said roller assembly including a roller for horizontal movement along the track, and an integral extruded holder for connection of the roller to the screen, said holder including a connecting bar portion attached to the roller and a bracket portion for adjustably holding a screen door, the bracket portion shaped generally as a U extending downwardly from the roller portion, one side of the U including a slot for adjustability of the screen.

2. A hanger assembly as in claim 1, wherein said slot is angularly disposed.

3. A hanger assembly as in claim 2, further including a horizontally extending bug strip.

* * * * *